US009347171B2

(12) United States Patent
Grunert et al.

(10) Patent No.: US 9,347,171 B2
(45) Date of Patent: May 24, 2016

(54) METHOD AND DEVICE FOR CLEANING A COMPONENT, PARTICULARLY AN EVAPORATOR OF A CONDENSER DEVICE, AND WASHER/DRYER OR DRYER HAVING SUCH A DEVICE

(75) Inventors: Klaus Grunert, Berlin (DE); Dimitri Pischits, Wiesbaden (DE); Ralf Willwert, Bischofsheim (DE); Oliver Wuttge, Hofheim (DE)

(73) Assignee: BSH Haugeräte GmbH, Munich (DE)

( * ) Notice: Subject to any disclaimer, the term of this patent is extended or adjusted under 35 U.S.C. 154(b) by 765 days.

(21) Appl. No.: 12/682,283

(22) PCT Filed: Sep. 24, 2008

(86) PCT No.: PCT/EP2008/062751
§ 371 (c)(1),
(2), (4) Date: Apr. 13, 2010

(87) PCT Pub. No.: WO2009/050004
PCT Pub. Date: Apr. 23, 2009

(65) Prior Publication Data

US 2010/0212369 A1 Aug. 26, 2010

(30) Foreign Application Priority Data

Oct. 12, 2007 (DE) ..... 10 2007 049 061

(51) Int. Cl.
*D06F 58/24* (2006.01)
*D06F 58/20* (2006.01)
*D06F 58/22* (2006.01)

(52) U.S. Cl.
CPC ..... *D06F 58/24* (2013.01); *D06F 58/20* (2013.01); *D06F 58/22* (2013.01)

(58) Field of Classification Search
CPC . D06F 58/22; D06F 58/24; D06F 2058/2832; D06F 39/022; D06F 39/083; D06F 39/088; D06F 39/028; A47J 31/46; B67D 2001/0089; B67D 3/02; B67D 3/043; B67D 3/045; B67D 1/1438; F16K 31/566; F16K 31/0655; A47L 15/4418; A47L 15/4214; A47L 15/4223; A47L 15/44; F01M 11/0408
USPC ..... 68/13 R, 208; 137/113; 222/509, 518; 251/246, 323
See application file for complete search history.

(56) References Cited

U.S. PATENT DOCUMENTS 404,192 A * 5/1889 Haas ..... 222/509
1,526,101 A * 2/1925 Sund ..... 222/181.2
(Continued)

FOREIGN PATENT DOCUMENTS

CN 1609326 4/2005
CN 1873084 12/2006
(Continued)

OTHER PUBLICATIONS

Machine Language Translation of DE 3738031 Al.*
(Continued)

*Primary Examiner* — Michael Kornakov
*Assistant Examiner* — Marc Lorenzi
(74) *Attorney, Agent, or Firm* — Nixon & Vanderhye, P.C.

(57) ABSTRACT

A device for cleaning an evaporator of a condenser with condensation water. The device includes a condensation water pan that collects condensation water condensed from process air by the evaporator, and a collection container above the evaporator that receives the condensation water from the condensation water pan and that dispenses the condensation water with a gush onto the evaporator from a rinsing chamber of the collection container with a sudden opening of a closure part through a downpipe.

57 Claims, 4 Drawing Sheets

(56) References Cited

U.S. PATENT DOCUMENTS

| | | | | |
|---|---|---|---|---|
| 1,626,969 | A | 5/1927 | Reeves | |
| 2,578,994 | A * | 12/1951 | Dunaway | D06F 39/022 134/100.1 |
| 2,660,396 | A * | 11/1953 | Heagerty | D06F 39/083 251/297 |
| 2,742,708 | A * | 4/1956 | McCormick | 34/76 |
| 2,771,228 | A | 11/1956 | Dobbie et al. | |
| 2,843,943 | A | 7/1958 | Geldhof et al. | |
| 3,072,129 | A * | 1/1963 | Seal | A47L 15/4223 134/107 |
| 3,083,557 | A | 4/1963 | Decatur | |
| 3,103,112 | A | 9/1963 | Behrens et al. | |
| 3,162,032 | A * | 12/1964 | Behrens | D06C 7/00 137/266 |
| 3,268,202 | A | 8/1966 | Murray et al. | |
| 3,572,553 | A * | 3/1971 | Ogden | 222/67 |
| 3,650,281 | A * | 3/1972 | Hurst | 134/58 R |
| 3,709,732 | A | 1/1973 | Thomen | |
| 3,768,514 | A * | 10/1973 | Goto | D06F 39/083 137/863 |
| 3,910,499 | A | 10/1975 | Trouilhet | |
| 3,940,861 | A * | 3/1976 | Frazar | 34/75 |
| 4,069,521 | A | 1/1978 | Aleman | |
| 4,345,343 | A | 8/1982 | Shipman | |
| 4,635,824 | A * | 1/1987 | Gaunt et al. | 222/129.1 |
| 4,653,200 | A | 3/1987 | Werner | |
| 4,678,892 | A * | 7/1987 | Finger | F24H 9/2014 122/504 |
| 4,700,492 | A | 10/1987 | Werner et al. | |
| 4,743,933 | A | 5/1988 | Rentschler | |
| 4,891,892 | A | 1/1990 | Narang | |
| 5,050,259 | A | 9/1991 | Tsubaki et al. | |
| 5,104,165 | A | 4/1992 | Anderson et al. | |
| 5,148,768 | A * | 9/1992 | Hinton | 119/500 |
| 5,152,159 | A * | 10/1992 | Kabeya et al. | 68/12.02 |
| 5,193,562 | A * | 3/1993 | Rigby | A47L 15/0086 134/100.1 |
| 5,226,203 | A | 7/1993 | Sacconato et al. | |
| 5,272,781 | A | 12/1993 | Bastin et al. | |
| 5,345,957 | A | 9/1994 | Cooper et al. | |
| 5,505,593 | A | 4/1996 | Hartley et al. | |
| 5,706,588 | A | 1/1998 | Dausch et al. | |
| 5,719,553 | A | 2/1998 | Lamparter | |
| 6,042,028 | A | 3/2000 | Xu | |
| 6,308,760 | B1 | 10/2001 | Finzo et al. | |
| 7,213,349 | B1 | 5/2007 | Brunner | |
| 7,251,905 | B2 * | 8/2007 | Doh et al. | 34/603 |
| 7,412,853 | B2 | 8/2008 | Hong et al. | |
| 8,266,814 | B2 | 9/2012 | Grunert et al. | |
| 2002/0145008 | A1 | 10/2002 | Jones et al. | |
| 2003/0029705 | A1 * | 2/2003 | Qiu et al. | 200/181 |
| 2004/0162149 | A1 | 8/2004 | Bayer et al. | |
| 2005/0066538 | A1 | 3/2005 | Goldberg et al. | |
| 2006/0125284 | A1 | 6/2006 | Kristi | |
| 2006/0145793 | A1 * | 7/2006 | Ning et al. | 335/78 |
| 2006/0151054 | A1 * | 7/2006 | Deaton | A47L 13/51 141/85 |
| 2006/0159519 | A1 | 7/2006 | Schluter et al. | |
| 2006/0179676 | A1 | 8/2006 | Goldberg et al. | |
| 2006/0272359 | A1 | 12/2006 | Kang | |
| 2007/0113327 | A1 | 5/2007 | Denkewicz, Jr. et al. | |
| 2008/0068772 | A1 | 3/2008 | Kubo et al. | |
| 2009/0320312 | A1 | 12/2009 | Azpilicueta | |
| 2010/0065087 | A1 | 3/2010 | Grunert | |
| 2010/0101606 | A1 | 4/2010 | Grunert | |
| 2010/0212369 | A1 | 8/2010 | Grunert et al. | |
| 2010/0243002 | A1 | 9/2010 | Grunert et al. | |
| 2010/0257669 | A1 | 10/2010 | Kennedy et al. | |
| 2011/0114135 | A1 | 5/2011 | Baurmann et al. | |
| 2011/0302967 | A1 | 12/2011 | Grunert et al. | |

FOREIGN PATENT DOCUMENTS

| | | | |
|---|---|---|---|
| CN | 101307557 | | 11/2008 |
| DE | 2256404 | B1 * | 7/1973 |
| DE | 2702639 | | 7/1978 |
| DE | 2933513 | A * | 3/1981 |
| DE | 3321245 | | 12/1984 |
| DE | 3738031 | A1 * | 5/1989 |
| DE | 4035225 | | 5/1992 |
| DE | 4212965 | A1 * | 10/1993 |
| DE | 4303655 | | 8/1994 |
| DE | 4333901 | | 2/1995 |
| DE | 19600489 | | 7/1996 |
| DE | 19511344 | | 10/1996 |
| DE | 19639331 | | 3/1998 |
| DE | 19701225 | A1 * | 7/1998 |
| DE | 19943125 | A1 | 11/2000 |
| DE | 10002742 | | 6/2001 |
| DE | 10002743 | A1 | 8/2001 |
| DE | 102005014842 | | 5/2006 |
| DE | 102006006080 | A1 | 8/2007 |
| DE | 102006018469 | | 10/2007 |
| DE | 102007016074 | A1 | 10/2008 |
| EP | 430664 | A1 | 6/1991 |
| EP | 0468573 | A1 | 1/1992 |
| EP | 0548386 | | 6/1993 |
| EP | 0731203 | A1 * | 9/1996 |
| EP | 0731204 | | 9/1996 |
| EP | 0740012 | A1 * | 10/1996 |
| EP | 0816549 | | 1/1998 |
| EP | 1055767 | A1 * | 11/2000 |
| EP | 1098028 | | 7/2004 |
| EP | 1936022 | | 6/2008 |
| FR | 2664625 | A1 | 1/1992 |
| FR | 2711153 | | 4/1995 |
| GB | 2115127 | A * | 9/1983 |
| KR | 2002031581 | A | 5/2002 |
| WO | WO 2007062905 | | 6/2007 |
| WO | 2008/067352 | | 6/2008 |
| WO | WO 2008119611 | | 10/2008 |
| WO | WO 2009/095312 | | 8/2009 |

OTHER PUBLICATIONS

Machine Translation of DE3738031A1.*
EP1055767 A1—Machine Translation.*
DE 4212965 A1—Machine Translation.*
DE2256404B1—Machine Translation.*
DE2933513A—Machine Translation.*
DE19701225A1—Machine Translation.*
Non-Final Office Action issued in related U.S. Appl. No. 13/203,262 dated Aug. 21, 2014, 13 pages.
Non-Final Office Action issued in related U.S. Appl. No. 13/002,787 dated Sep. 2, 2014, 33 pages.
English Translation of the First Office Action and Search Report for Chinese Application No. 201080014638.8, 3 pages, issued Nov. 2, 2012.
English Translation of the Third Office Action and Search Report for Chinese Application No. 201080014638.8, 4 pages, issued Oct. 8, 2013.
National Search Report DE 10 2009 002 076.4, issued Apr. 1, 2009, English Translation.
International Search Report PCT/EP2010/053258, issued Aug. 10, 2010, English translation.
Office Action issued in U.S. Appl. No. 13/002,787, dated Sep. 4, 2015, (30 pages).
Office Action in U.S. Appl. No. 13/002,787, dated Dec. 16, 2014 (24 pages), including PTO-892 citing Dobbie et al., U.S. Pat. No. 2,771,228, issued Nov. 20, 1956.
Office Action issued in U.S. Appl. No. 12/532,203, dated Feb. 13, 2015, (52 pages).
Office Action issued in U.S. Appl. No. 13/256,474, dated Mar. 5, 2015, (20 pages), including PTO-892 citing Trouilhet, U.S. Pat. No. 3,910,499, issued Oct. 7, 1995 and Brunswick et al., WO 2008067352 A2, issued Jun. 5, 2008.

(56) References Cited

OTHER PUBLICATIONS

Office Action issued in U.S. Appl. No. 12/532,203, dated Jun. 30, 2015, (26 pages).
Report of Examination of Eurasian Application No. 201070558, dated Jan. 23, 2013 (2 pages).
National Search Report CN 201080011890.6, dated Jan. 25, 2013 (1 page).
International Search Report PCT/EP2010/052082, dated Sep. 16, 2010 (3 pages).
National Search Report DE 10 2009 001 548, dated Jan. 26, 2010 (3 pages).
Roemheld, "Quick-Disconnect Coupling," www.roemheld.com, issue 11-08 E.
Roemheld, "Betriebsanlietung Schnellverschlusskupplungen," www.roemheld, Jan. 2004.
Office Action (Final) issued in U.S. Appl. No. 13/002,787, dated Feb. 22, 2016 (24 pages).
Office Action (Examiner's Answer to Appeal Brief) issued in U.S. Appl. No. 13/256,474, dated Nov. 19, 2015 (25 pages).
Office Action (Non-Final) issued in U.S. Appl. No. 12/532,203, dated Dec. 16, 2015 (17 pages).

* cited by examiner

METHOD AND DEVICE FOR CLEANING A COMPONENT, PARTICULARLY AN EVAPORATOR OF A CONDENSER DEVICE, AND WASHER/DRYER OR DRYER HAVING SUCH A DEVICE

This application is a U.S. National Phase of International Patent Application No. PCT/EP2008/062751, filed Sep. 24, 2008, which designates the U.S. and claims priority to German Patent Application No. DE 10 2007 049 061.7, filed Oct. 12, 2007, the entire contents of each of which are hereby incorporated by reference.

BACKGROUND OF THE INVENTION

The invention relates to a method and device for cleaning a component arranged within a process air circuit of a washer/dryer or dryer, particularly an evaporator of a condenser device, by means of condensation water acquired in the process air circuit from the drying of moist laundry and collected in a condensation water pan, from which it is guided to a collection container provided above the evaporator and is dispensed from its outlet side onto the evaporator concerned. The invention further relates to a washer/dryer or dryer with a device of the above type. It should be pointed out here that a washer/dryer is understood to be a combination unit which has a washing function for washing laundry and a drying function for drying moist laundry. A dryer on the other hand only has a drying function for drying moist laundry.

A method and a device of the above type for removal of lint from a condensation water separator embodied as a heat exchanger are already known (DE 37 38 031 C2). In the relevant known method and with the device provided for carrying it out, a relatively small amount of around half a liter of condensation water is used for one-off rinsing of the plates of the condenser device provided. The rinsing process concerned lasts about 30 seconds in this method. However, to remove lint effectively from the condenser device which has remained suspended in the condenser device concerned during the drying of moist laundry, a relatively strong rinsing of the condenser device is necessary. However this demands the use of a relatively powerful pump which pumps the condensation water out of the condensation water pan to the available rinsing device. There is sometimes the desire however to avoid this type of high outlay and to make do with a more simple arrangement in order to clean a component arranged within a process air circuit of a washer/dryer or dryer, especially an evaporator of a condenser device, by means of the condensation water collected in a condensation water pan.

A device for cleaning the evaporator of a condenser device in a dryer is also known (EP 0 468 573 A1). With this known device the evaporator of the condenser device consisting of a plurality of fins arranged in parallel with each other can be cleaned on its side opposite to a condensation water pan by means of a cleaning device. This cleaning device consists of a brush or an arrangement of bristles able to be moved backwards and forwards to which condensation water additionally contained in the condensation water pan is fed. With this known device however the cleaning of the evaporator of the condenser device is relatively poor since the comb-shaped cleaning device is only in a position to clean the upper area of the evaporator of the condenser device, but not the significantly larger area lying below it. This might possibly be able to be cleaned by the comb-type cleaning device being provided with bristles which extend over the entire depth of the evaporator. However, provided this were able to function at all, it would demand a relatively high energy outlay and thereby a relatively high constructional outlay because of the significant friction between the bristles of the comb-type cleaning device and the side walls of the fins of the evaporator. Such an outlay is however seen as undesirable.

A method and a household dryer for cleaning a section of a process airflow guide are also known (DE 199 43 125 A1). In this device a fan is provided to generate the process airflow which can be brought into contact in a drying compartment with the laundry to be dried to enable it to take up moisture. Outside the drying phase in which the process airflow is created by means of the fan and is brought into contact in the drying compartment with the laundry to be dried, in a cleaning phase with the fan switched off, a section of the process air guide is flooded at least partly for a specific period with a liquid. This liquid is removed again at the end of the cleaning phase from the flooded section of the process air guide. The relevant liquid especially involves condensation liquid from a condensation container in which condensation water is collected during the drying of the laundry which is obtained from drying moist laundry. To be able to undertake the said flooding of the said section of the process air guide, this is to be sealed by means of a sealing arrangement which is however currently viewed as undesirable because of the associated outlay. A more simple solution for cleaning a component arranged within a process air circuit of a washer/dryer or tumble dryer is therefore being sought.

A method for removing lint from a heat exchanger of a household appliance as well as a corresponding household appliance has also already been proposed (official file reference 10 2006 061 211.6—internal file reference: 200602617), for which a rinsing liquid especially formed by a condensation created during the drying process in the household appliance is diverted as a function of the strength of a flow of air and, depending on the diversion, flows through different areas of the heat exchanger. In this case however an efficient cleaning of the heat exchanger can only be achieved with a sufficiently large volume and/or with sufficiently fast flowing rinsing liquid. How this is to be achieved however is left open in the relevant context.

Finally a method and a device for cleaning a component, especially an evaporator of a condenser device disposed within a process air circuit of a washer/dryer or a dryer by means of condensation water have already been proposed (official file reference DE 10 2007 016 074.9—internal file reference 200601639), wherein the condensation water is obtained in the process circuit from the drying of moist laundry and is captured in a condensation water pan, from which it is directed to a rinsing container provided above the evaporator and from the outlet side of which it is dispensed onto the relevant evaporator by sudden opening of the relevant rinsing container on its outlet side as a gush of water onto the said component. In addition to the relevant rinsing container a special collection container is also provided into which condensation water can also be pumped from the condensation water pan which can be drained away as waste water by emptying the relevant collection container. This separate provision of rinsing container and collection container involves an additional outlay in terms of construction for both control and processing, which is however currently undesirable.

BRIEF SUMMARY OF THE INVENTION

The underlying object of the invention is therefore to show a way in which, in an especially simple manner, a component arranged within process air circuit of a washer/dryer or dryer, to with especially an evaporator of a condenser device, can be cleaned especially effectively by means of condensation water without significant outlay being required to do so both in terms of control and thereby in terms of process technology and also in terms of production, without this requiring an appreciable outlay.

The object illustrated here is inventively achieved with a method of the type mentioned at the start in accordance with the invention by the condensation water being fed to a rinsing chamber of a collection container containing said rinsing chamber and an overflow area serving as a storage chamber, from the rinsing container of which the condensation water contained therein is dispensed onto the said component by sudden opening of the rinsing container concerned on its outlet side as a gush of water and from the storage chamber of which the condensation water contained therein is drained away as waste water.

The inherent advantage of the invention is that on the one hand rinsing water and storage water can be collected in a relatively simple manner from the condensation water collected in the condensation water pan, on the other hand by a simple method step, namely by dispensing the condensation water from the rinsing container, the water can escape as a gush of water and additionally the condensation water collected as storage water can simply be drained away. By dispensing the condensation water from the rinsing chamber as a gush of water, a component disposed in the process air circuit of a washer/dryer or a dryer and particularly an evaporator of a condenser device can be efficiently cleaned, and in particular lint can be cleaned off which has collected on it during a drying process of moist laundry. If for example a volume of condensation water of 2.5 liters is assumed, which is collected in the rinsing chamber, the said efficient cleaning of the component or evaporator of the condenser device is achieved by this volume of condensation water being dispensed within a period of around 1 sec to 2 secs. In the case of dispensing 2.5 liters of condensation water within 1 sec, this corresponds to a dispensing volume of 150 liters/min of condensation water. In the case of dispensing 2.5 liters of condensation water within 2 secs taken as the example, this corresponds to a dispensing volume of 75 liters/min of condensation water. Such volumes of water—if one wanted to use a pump to dispense them—could in any event only be dispensed by a relatively large-volume and powerful pump, the use of which in washer/dryers or tumble dryers for pumping condensation water to clean components arranged there within the process air circuits, and especially evaporators of condenser devices, could not be considered.

In accordance with an expedient embodiment of the invention, in addition to the dispensing of the rinsing water from the rinsing chamber by a sudden opening of said chamber on the outlet side as a gush of water, mains water still under pressure is dispensed onto the component concerned. In this way the effect of cleaning the said component can be even further enhanced in a relatively simple manner.

Expediently the condensation water contained in the storage chamber of the collection container can be drained away by emptying the collection container concerned after it has been removed from a holder device. The advantage of this is that the condensation water from the storage chamber of the collection container can be drained away in a relatively simple manner.

In an advantageous manner, the water contained in the storage chamber of the collection container can be emptied out by draining it and/or pumping it into a waste water collection device, since in this way the respective condensation water contained in the storage chamber of the collection container can be drained away without taking the collection container out of a holder device and without any further manual handling.

Preferably the gush of water to be dispensed onto the component is largely evened out between the beginning and end of being dispensed. This produces the advantage of a relatively even rinsing effect between the beginning and the end of the dispensing of the gush of water onto or into the component to be cleaned.

In accordance with a further expedient embodiment of the present invention for an evaporator of a condenser device forming the said component, the gush of water is only to be dispensed to an evaporator area located at a defined distance from the inlet area of the process air into the evaporator. The advantage of this is that increasing deposits usually occurring in the overall inlet area of the evaporator in the form of lint can be effectively removed. In this case the dispensing of the gush of water is preferably undertaken immediately after ending a drying process of moist laundry to be dried, since at this point in time contaminants, especially lint, adhering to the said component or evaporator of the condenser device are still moist and are relatively easy to remove by the rinsing liquid dispensed as a gush of water.

In accordance with another expedient development of the present invention for the evaporator of a condenser device forming the said component, the dispensing of the gush of water is undertaken by mechanically or electromechanically diverting it from a starting area provided at the inlet area of the process air into the evaporator through to an end area lying at a distance from the start area in the direction towards the outlet area of the process air from the evaporator. The advantage of this is that the component to be cleaned, and especially the evaporator of a condenser device, can be cleaned in a relatively simple manner over a definable area. The area concerned can extend in such cases from the entry area of the process air into the evaporator through to its exit area from the evaporator. The gush of water is also dispensed in this case preferably immediately after ending a drying process of moist laundry to be dried, since at this point in time contaminants, especially those adhering to the said component or evaporator of the condenser device, are still moist and can be removed well by the rinsing liquid dispensed as a gush of water.

Expediently the condensation water is pumped by means of a pump from the condensation water pan into the rinsing container. This represents a relatively simple option for providing the condensation water which is dispensed as a gush of water for cleaning the component especially formed by an evaporator of a condenser device. In such cases a relatively small pump having a low power is advantageously sufficient to pump the condensation water from the condensation water pan into the rinsing container. The power of such a pump is well below, especially orders of magnitude below, the power of a pump that has been mentioned in the context of the basic embodiment of the present invention.

Expediently the sudden opening of the rinsing container on its outlet side is controlled by actuation of a bistable rinsing chamber closure. The advantage of this is an especially effective sudden opening of the rinsing chamber on its outlet side. In this case advantageous use can be made of the effect that a relatively short actuation stroke on the control side can achieve a relatively large stroke on the controlled side of an actuation element for actuating the rinsing chamber closure. In addition, in an advantageous manner, a so-called step function imparted to the bistable rinsing chamber closure for the actuation of the rinsing container closure can be exploited through which a sudden movement of the rinsing container closure or opening it and also closing it is able to be carried out.

Preferably the previously-mentioned rinsing chamber closure is actuated thermally or electromagnetically. This has the advantage of an especially simple actuation of the rinsing chamber closure.

For carrying out a method in accordance with the invention a device is preferably used with a component to be cleaned arranged within a process air circuit of a washer/dryer or dryer, especially an evaporator of a condenser device, and with a condensation water pan in which condensation water arising in the process air circuit through drying of moist laundry is able to be collected, is able to be directed from said pan to a collection container provided above the evaporator and is able to be dispensed from this container onto the component concerned. This device is characterized in accordance with the invention by the collection container having a rinsing chamber with an inlet area for condensation water from the condensation water pan and an outlet area for dispensing the condensation water contained in the rinsing chamber, as well as an overflow area serving as a storage chamber and by a closure part being arranged on an exit side of the outlet area of the rinsing chamber, the sudden opening of which allows the collection container to dispense the condensation water contained in its rinsing chamber as a gush of water through a downpipe onto the said component.

The advantage of this is an especially low outlay for the device for cleaning a component arranged within a process air circuit of a washer/dryer or tumble dryer, and especially an evaporator of a condenser device. By the sudden opening of the rinsing container at its outlet side the condensation water collected in the rinsing container can namely be dispensed in an efficient manner rapidly as a gush of water onto the component to be cleaned, without additional devices being required for this purpose. In addition of the collection container concerned is used in an advantageous manner as a combination container also abbreviated to combi container, with its storage chamber simultaneously used as a storage container. By dividing up the collection container by means of a partition or separating wall into a rinsing chamber to which condensation water can be directly supplied from the condensation water pan and into a storage chamber serving as an overflow area for the rinsing chamber, the further advantage is obtained of ensuring that condensation water even in the event of a small load of laundry to be dried in the washer/dryer or dryer containing the relevant collection container, a sufficient quantity of condensation water is available for cleaning the component to be cleaned and is not used in any other way or drained off.

In accordance with the further expedient embodiment of the invention, in addition to the dispensing of the rinsing water from the rinsing chamber on the outlet side as a gush of water via its sudden opening, mains water is still under pressure is able to be dispensed onto the component concerned. In this way the effect of cleaning the said component can be even further enhanced without any especially great effort. Use can preferably be made of such a measure in a washer/dryer in which a water inlet device for supplying mains water under pressure and a water outlet device for draining away waste water are available in any event.

Preferably the condensation water contained in the storage chamber of the collection container is able to be drained away through the inlet area of the rinsing chamber of the relevant collection container after it has been taken out of a holder device. This results in a particularly simple-to-design collection container.

It is of particular advantage in accordance with a further expedient embodiment of the device in accordance with the invention for the condensation water contained in the storage chamber of the collection container to be able to be drained away by a drainage device and/or a pump into a waste water collection device. In this way the condensation water contained in the storage chamber of the collection container in each case can be drained away without removing the collection container from the holder device and without any further manual handling. And this means that it is possible to make do with a relatively low constructional outlay for accommodating the collection container in a washer/dryer or a dryer.

Expediently the said downpipe has an area which is narrowed in relation to the cross section of the outlet area of the rinsing chamber. This enables a good evening-out of the dispensing of the gush of water between its beginning and its end to be achieved in a relatively simple manner.

In accordance with a further expedient embodiment of the invention, for an evaporator of a condenser device forming the said component, the gush of water is able to be dispensed to an evaporator area preferably only at a defined distance from the inlet area of the process air into the evaporator by means of a rinsing nozzle connected to the downpipe arranged at a fixed location. The advantage of this is an especially effective cleaning of the main area of the evaporator to be cleaned into which the process air enters and where it particularly deposits contaminants such as lint.

In accordance with another expedient development of the present invention the rinsing nozzle and/or the downpipe are able to be diverted during the dispensing of the gush of water by a mechanically or electromechanically-actuated diversion device from a starting area located at the inlet area of the process air into the evaporator of the condenser device to an end area at a distance therefrom in the direction of the outlet area of the process air from the evaporator. The advantage of this is that the evaporator of the condenser device is to be cleaned by the said gush of water over a definable length, which can especially be its entire length over which the process air flows through it and if necessary by mains water which is under pressure.

Expediently the rinsing container is connected to the condensation water pan by means of a pump. The advantage of this is that the rinsing container can be filled with condensation water in a relatively simple manner.

Preferably the closure part of the rinsing container is connected to a bistable spring arrangement which is able to be actuated to open the outlet area of the rinsing container closed off by the closure part. The advantage of this is that the closure part of the rinsing container can be opened especially securely by the bistable effect of the spring arrangement. The relevant opening can in this case be undertaken especially quickly by the relevant bistable spring arrangement being given a step function to switch over into its respective bistable position.

For the previously mentioned actuation of the bistable spring arrangement a thermal or magnetic relay coupled by means of this is preferably provided. This has the advantage of an especially low effort being adequate for controlling the bistable spring arrangement.

BRIEF DESCRIPTION OF THE DRAWINGS

The present invention will be explained in greater detail by examples which refer to drawings.

The figures in the drawings are as follows.

DETAILED DESCRIPTION OF EXEMPLARY EMBODIMENTS OF THE PRESENT INVENTION

Figure 1:
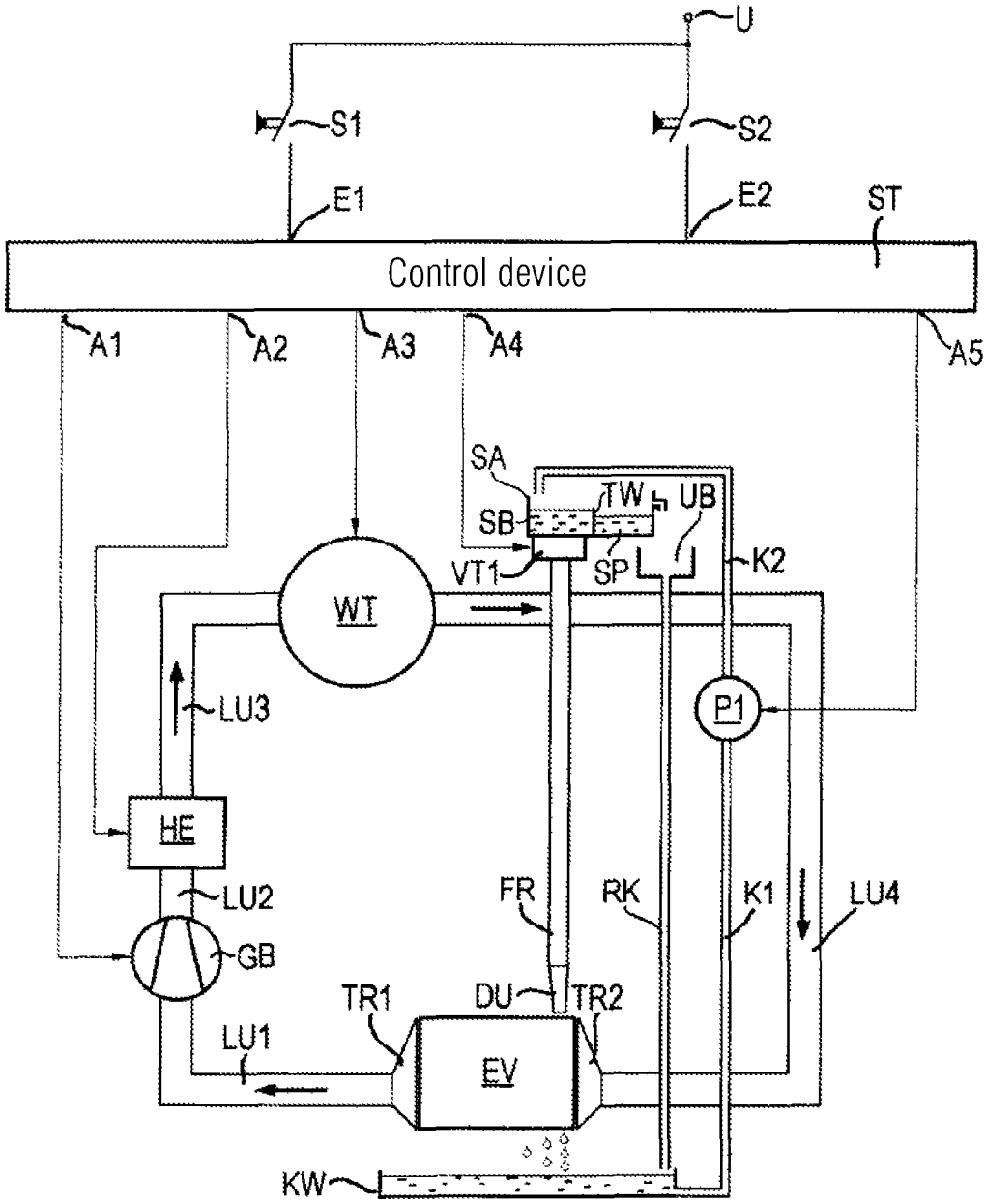
FIG. 1 a schematic diagram of a device in accordance with one embodiment of the present invention, FIG. 2 a schematic diagram in part cross section of a collection chamber provided in the device in accordance with FIG. 1 containing condensation water pushed into a device body and largely closed on its upper side by a cover, with an actuation device for sudden dispensing the condensation water contained in the rinsing chamber as a gush of water, FIG. 3 a schematic diagram of the collection container shown in FIG. 2 in a state in which it has been partly withdrawn from the said device body, FIG. 4 an overhead view of the collection container shown in FIGS. 2 and 3 with the cover removed, FIG. 5 a schematic diagram of a possible guidance device for the collection container shown in FIG. 4, FIG. 6 a schematic diagram of an overhead view of an evaporator of a condenser device as is provided in the device depicted in FIG. 1, FIG. 7 an arrangement through which the condensation water dispensed as a gush of water from the rinsing chamber of the collection chamber for the device in accordance with FIG. 1 is able to be dispensed over a definable area of the evaporator of the condenser device, and FIG. 8 a modification of the device shown in FIG. 1 in accordance with the present invention.

Before the drawings are dealt with at greater length it should first be pointed out that the same elements or devices are labeled with the same reference signs in all the figures of the drawing.

The device shown in FIG. 1 in a schematic diagram in accordance with an embodiment of the present invention is contained in a washer/dryer or a dryer, of which the parts shown in FIG. 1 are only those which are of significance for understanding the present invention. These parts include above all a washer/dryer or dryer drum WT containing moist laundry to be dried and a process air flow arrangement connected to said drum examined below in greater detail, through which process air flows in a direction indicated by the arrows in FIG. 1.

The process airflow arrangement comprises a series of process air ducts LU1, LU2, LU3 and LU4 as well as devices connected to these, namely a fan GB, a heating device HE and an evaporator EV of a condenser device not shown in any greater detail in this figure. The evaporator EV in this case is connected on its outlet side via a funnel-shaped connection TR1 serving as a transition part to the one end of the process air duct LU1, to which cold, dry process air is supplied and which is connected by its other end to the input connection of the fan GB. This fan GB is connected on its outlet side via the process air duct LU2 to the inlet side of the heating device HE, which is connected on its outlet side by the process air duct LU3 to the inlet side of the washer/dryer or tumble dryer drum WT for the supply of what is now hot, dry process air. On the outlet side the washer/dryer or tumble dryer drum WT, for acquiring hot, moist process air which is taken away from moist laundry to be dried in it, is connected by the process air duct LU4 to a funnel-shaped connection TR2 also adjoining it, likewise serving as a transition part, to the inlet side of the evaporator EV. In this evaporator EV condensation of the moisture from the hot, moist process air supplied by the process air duct LU4 from the washer/dryer or tumble dryer drum WT takes place. The condensation water arising from this process in the evaporator EV enters, as indicated in FIG. 1, in the form of water droplets a condensation water pan KW arranged below the evaporator EV, in which it is collected.

The condensation water collected in the condensation water pan KW must now be removed from said pan so that it doesn't overflow. To this end the condensation water pan KW is connected in the present example by a connecting duct K1 to the inlet side of an electric pump P1, which can be a vane-type pump for example. On its output side of the pump P1 is connected by a connection duct K2 to the input or inlet side of a rinsing chamber SB of a collection container SA. This collection container SA, in addition to the rinsing chamber SB, also has an overflow area serving as a storage chamber SP alongside the rinsing chamber SB. The rinsing chamber SB and the storage chamber SP of the collection container SA are merely separated from one another by a partition wall TW which is lower in height than the rinsing chamber SB and the storage chamber SP. The water pumped up by the pump P1 from the condensation water pan KW initially arrives through the connecting duct K2 in the inlet area of the rinsing chamber SB. Since the height of the partition wall TW, as mentioned, is lower than the height of the rinsing chamber SB and the storage chamber SP and thus lower than the edge areas of the collection container SA, the rinsing chamber SB is first filled with condensation water from the condensation pan KW. Once the rinsing chamber SB of the collection chamber SA is filled with condensation water, further condensation water supplied to it flows over the partition wall TW as overflow water into the storage chamber SP in which it remains initially. Any water possibly overflowing from the storage chamber SP then flows for safety's sake through an overflow arrangement into a return channel RK and thus directly back into the condensation water pan KW. The collection container SA thus represents a combination container, or combi container for short.

The collection container SA can be a collection container able to be removed manually from an opening to accommodate it provided in the associated washer/dryer or dryer through which the condensation water pumped up into it from the condensation water pan KW can be disposed of, and this can especially involve the condensation water contained in the storage chamber SP after the condensation water collected in the rinsing chamber SP has been dispensed for cleaning the evaporator EV. The disposal of the condensation water from the collection container SA can also be undertaken however by the relevant collection container SA being taken out of the washer/dryer or dryer and emptied into a waste water disposal facility. This emptying can be undertaken manually in such cases. It is also possible however for the condensation water contained in the storage chamber SP to be pumped away by means of an electric pump and directed into the waste water disposal facility mentioned. In this case the collection container SA does not need to be taken out of the opening mentioned above.

The rinsing chamber SB of the collection container SA is connected to a downpipe FR by its output or outlet side via a normally closed closure part VT1, which is to be opened by actuating it or controlling it. This downpipe FR, having a relatively large cross section, preferably has a length defining a drop of around 500 mm to 600 mm for the condensation water to be dispensed as a gush of water from the rinsing container SB. It is connected at its lower end in FIG. 1 to a permanently arranged outlet area extending over the entire width of the evaporator EV to an approximately oval shaped rinsing nozzle DU with the width of around 6 mm to 10 mm, which is arranged with the longitudinal center of its outlet area at a defined distance, amounting here to around 10 mm to 50 mm, from the inlet area of the evaporator EV for hot, moist process air lying to the right in FIG. 1. Through this arrangement of downpipe FR and rinsing nozzle DU, condensation water coming out of the rinsing container SB as a gush of water when the closure part VT is opened can be dispensed to an area of the evaporator preferably located only at the defined distance from the inlet area of the process air into the evaporator. The dimensions of the through-opening of the closure part VT as well as the cross-section of the downpipe FR and of the rinsing nozzle DU are preferably selected in such cases so that the condensation water collected in the collection container SB—thus in accordance with the example assumed above around 2.5 liters of condensation water—is dispensed within a very short period of time of between one and two seconds as a gush of water onto the evaporator EV. Dispensing such a gush of water, i.e. at a speed of a least 2.5 liters in two seconds and preferably immediately after carrying out the drying process of the moist laundry which is located in the washer/dryer or tumble dryer drum WT for drying, results in an especially effective way in enabling lint and other contaminants to be rinsed away from the said process air inlet area of the evaporator EV and beyond this area which have been fed in via the process air duct LU4 and the funnel-shaped connection TR2.

In order to achieve a largely even dispensing quantity of the gush of water between the beginning and the end of it being dispensed, it has proved expedient for the downpipe to have an area to which the rinsing nozzle DU also belongs which is narrowed in relation to the cross section of the outlet area of the rinsing container SB. However it is to be ensured in this case that the previously specified minimum volume of condensation water per unit of time is provided for rinsing the evaporator EV.

To control the different devices shown in FIG. 1, as has been explained above, a control device ST is provided. This control device ST can typically comprise a microcontroller with its own software or a microprocessor control with a CPU, a ROM memory containing an operating program and a processing program and a random access memory RAM as well as interface circuits to which actuation signals are supplied on the input side and which allow control signals to be output on the output side to the various units of the device shown in FIG. 1.

The control device ST depicted in FIG. 1 typically features two input terminals E2 and E1 to which switches S2 or S5 are connected which are each connected to a power connection U which might carry a voltage of +5V for example. On the output side of the control device ST typically features six output terminals A2, A3, A4, A5, A5 and A6.

Output terminal A1 of the control device ST is connected to a control input of the fan GB which can be switched on or off by control signals supplied to this control input by it.

Output terminal A2 of the control device ST is connected to a corresponding control input of the heating device HE which can be switched on or off by control signals supplied to this control input by it.

Output terminal A3 of the control device ST is connected via a connection only to be understood as an effective connection to the washer/dryer or dryer drum WT, which is able to be started into rotation or stopped by the control signals output via the corresponding connection. This means that the relevant control signals from the output terminal A3 of the control device ST will be output to a drive motor connected to the washer/dryer or dryer drum WT.

The output terminal A4 of the control device ST is connected to an actuation input of the closure part VT1, which is either closed or completely opened by control signals supplied to it from the output terminal A4 of the control device ST. It is however also possible for the closure part VT1 to be normally closed and only to be completely opened by a control signal output by the output terminal A4 of the control device ST (e.g. in accordance with a binary signal "1").

The output terminal A5 of the control device ST is connected to a control input of the said pump P1, which by control signals supplied to it through this connection can either be started into a pumping process or stopped.

In respect of the control device ST discussed here with its input terminals E1 and E2 and output terminals A1 through A5, it should also be pointed out that by closing the switch S1 connected to the input terminal E1 of the control device for example, the normal drying operation of the moist laundry located in the washer/dryer or dryer drum WT is initiated and carried out and that by closing the switch S2 connected to the input terminal E2 of the control device ST, the dispensing of condensation water from the suddenly opened rinsing container SB as a gush of water onto the evaporator EV is controlled. In this case the actuation of the two switches S1 and S2 can only be undertaken such that in each case only one of the two switches S1 and S2 is able to be actuated. The switches concerned S1 and S2 can also each be formed by a pushbutton.

The provision of the condensation water in the rinsing chamber SB from the condensation water pan KW can preferably be undertaken during a drying operation or after its conclusion automatically or explicitly by manual intervention into the program control of the washer/dryer or dryer containing the described device. In the event of such manual intervention into the program control the control device ST can be connected to a further input via a further switch (not shown) to the power terminal U. The dispensing of the gush of condensation water contained in the rinsing container onto the evaporator EV after the ending of the drying process enables lint and contaminants adhering to its fins LA to be easily rinsed away by the relatively high flow speed and the relatively large volume of condensation water. This rinsing process can if necessary be undertaken one or more times repeatedly with the relevant condensation water. To do this the condensation water collected again in the condensation water pan KW is to be pumped back up into the rinsing chamber SB from which it is then again dispensed onto the evaporator as a gush of water. After conclusion of the cleaning or rinsing process the condensation water collected in the condensation water pan KW is either to be drained away into an existing waste water system or pumped into the rinsing chamber SB and the storage chamber SP of the collection container SA which is then to be emptied manually.

Figure 2:
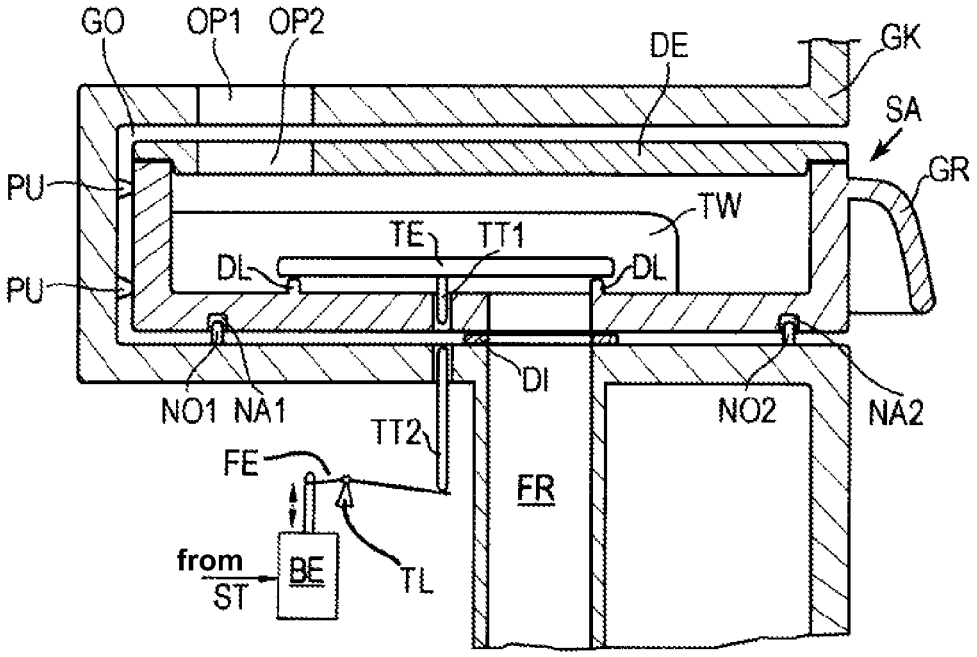
Figure 3:
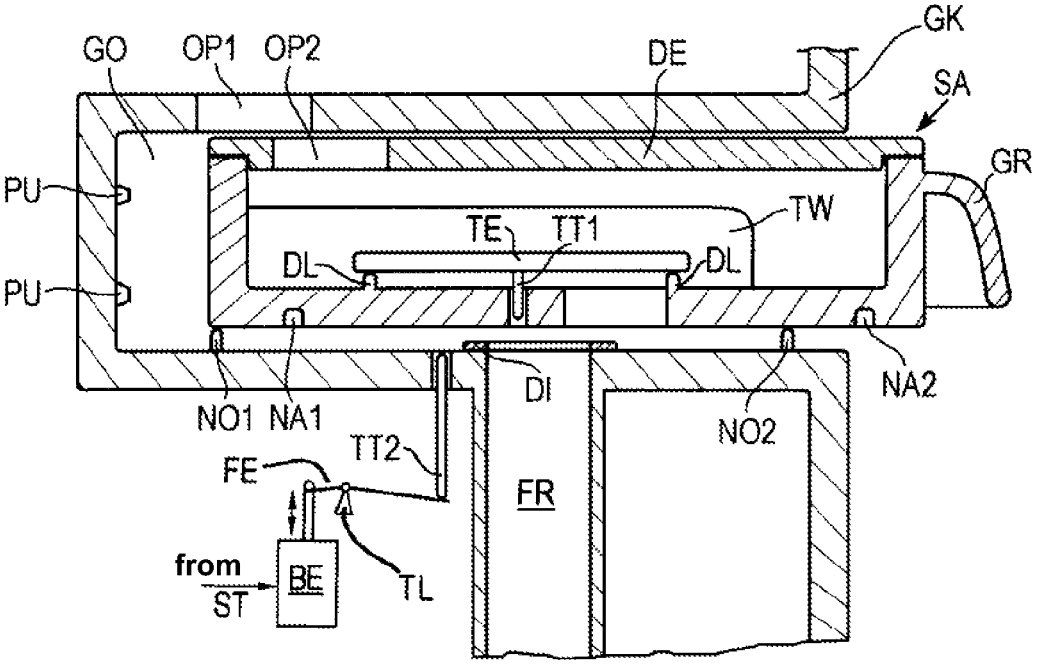

In FIGS. 2 and 3 the collection container SA only indicated schematically in FIG. 1 is illustrated in greater detail in a possible embodiment. FIGS. 2 and 3 show the collection container SA in a cross-sectional view as a cuboid body covered on its upper side by a cover DE. This cover DE can be connected to the relevant receiving body by a snap-in connection arrangement for example. At its end shown on the right in FIGS. 2 and 3 the relevant receiving body of the collection container SA has a grip GR with which the collection container SA is able to be pushed into a corresponding receiving opening of a device body GK of the washer/dryer or dryer. FIG. 2 shows the collection container SA in a state in which this is pushed fully into a receiving opening GO of the device body GK and FIG. 3 shows the case in which the collection container SA is slightly withdrawn from this receiving opening of the device body GK.

In the state in which it is pushed into the said receiving opening GO, the collection container SA rests with its end area shown on the left in FIG. 2 against buffers PU which from the inside of the receiving opening GO are in contact with the collection container SA. In this state the collection container SA is received with cam receivers NA1 and NA2 provided in its lower side by cams NO1 or NO2 which stand proud of the lower side of the relevant receiving opening GO. In this state the collection container SA is lowered in relation to the underside of said acceptance opening GO of the device body GK and thus makes a seal by means of a sealing element in the form of a sealing disk DI against the underside of the said acceptance opening GO. This enables moist process air which may be rising up in the downpipe FR to neither get into the collection container SA nor to reach the outside of the device body GK. In this state the outlet opening AU in the lower area of the collection container SA is namely closed and this is done by a closure adjuster TE which rests to form a seal against sealing areas or lips DL which protrude from the lower inner side of the collection container SA.

When the collection container SA is pulled out from said receiving opening GO by means of the grip GR the underside of the collection container SA slides onto the cams NO1 and NO2 and thereby prevents damage or wear to the sealing disc DI, as can be seen from FIG. 3.

In the position of the collection container SA shown in FIG. 2 two through-openings OP1 and OP2 are lined up with each other, of which the through-opening OP1 is a provided in the rear area of the said receiving opening GO of the device body GK and of which the through-opening OP2 is provided in the corresponding area of the cover DE of the collection container SA. Through these two through-openings lined up with each other which are preferably of the same size, condensation water is introduced through the connecting duct K2 shown in FIG. 1 into the collection container SA. The partition wall TW which has already been mentioned when discussing the collection container SA shown in FIG. 1 is indicated in this collection container SA. As can be seen from FIGS. 2 and 3, the height of the partition wall TW is lower than the height of the inner space of the collection container SA.

The closure adjuster TE shown in FIGS. 2 and 3 is supported by a short support part or support pin TT1 which is received in the through opening contained in the floor part of the collection container SA so that the collection container SA with the closure adjuster TE can be displaced relative to the said receiving opening GO.

In the position of the collection container SA shown in FIG. 2 an actuation pin TT2 lying opposite the support pin TT1 is located in a corresponding through-opening which is provided in the floor area of the said receiving opening GO. An actuation arrangement operates on this actuation pin TT2 which comprises an actuation device BE able to be controlled by the control device ST shown in FIG. 1 and also the bistable spring FE. This bistable spring typically formed by a leaf spring, which is preferably equipped with a step function, is supported at its support point by a static support part TL, around which the bistable spring FE concerned is in a position to be snapped over when actuated. At the end of its relative short pivot area from the support part TL the bistable spring FE is connected to a plunger of an actuation device BE. This actuation device might preferably be a thermally or electromagnetically-operating actuation device, such as a thermal relay or a magnetic relay, which is able to be controlled by the control device ST1 (from its output terminal A4 according to FIG. 4). The transmission ratio between the pivot areas of the bistable spring provided on both sides of the support part TL is in a position to initiate a relatively short stroke of the plunger of the actuation device in relation to a significantly larger stroke of the closure plate TE (lever principle), and preferably to do this on the basis of the bistable step function of the spring FE, so that the condensation water contained in the rinsing container can be dispensed as a gush of water through the downpipe and the rinsing nozzle to the evaporator EV according to FIG. 1.

The effect of a corresponding activation of the actuation device BE by the control device ST, as is shown in FIG. 1 is that the switchover of the bistable spring FE of the actuation pin TT2 pushes up the support pin TT1 and thus lifts the closure adjuster TE out of its sealing position on the sealing lips DL. In this way the rinsing chamber divided off by the partition wall TW in the collection container SA is connected directly to the downpipe FR and the condensation water collected in the rinsing chamber can be dispensed as a gush of water through the downpipe FR.

Figure 4:
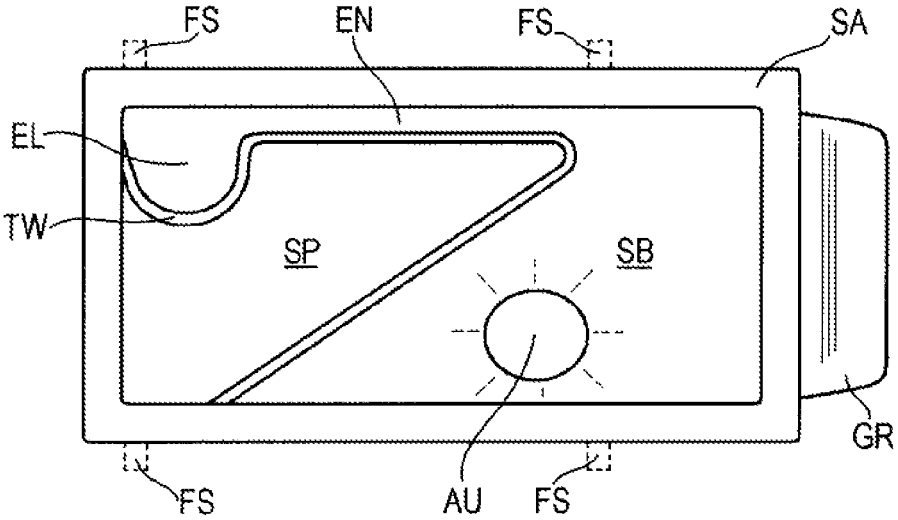

FIG. 4 shows an overhead view of the collection container SA shown in FIGS. 2 and 3 with the cover DE removed. As can be seen from FIG. 4 the partition wall TW initially runs within the inner space of the collection container SA from its end shown on the left almost in the form of the semicircle. This area labeled EL represents the inlet area for the condensation water which is pumped through the connection duct K2 mentioned above into the collection container SA. This inlet area EL is then adjoined by a narrowing area EN which then comes out into an expanded area which serves as a rinsing area of the rinsing chamber SB thus designed to be relatively large. The partition wall TW concerned then runs down to the lower side wall of the collection container SA shown in FIG. 4 and thus divides the inner space of the collection container SA into the rinsing chamber SB already mentioned and the storage chamber SB visible from FIG. 4. Located in the said rinsing chamber SB is the outlet opening AU mentioned in connection with FIGS. 2 and 3, which is shown here without a closure element such as the closure adjuster mentioned in connection with FIGS. 2 and 3. The floor area within the rinsing chamber SB can, as indicated by the dashed lines in FIG. 4, be designed so that this floor area runs down somewhat in the shape of a funnel to the outlet opening AU. This enables the exit of the condensation water collected in the rinsing chamber SB to be further supported by the outlet opening AU. Condensation water from the rinsing chamber SB only runs over the partition wall TW into the previously mentioned storage chamber SP of the collection container SA after the rinsing chamber SB is filled with condensation water.

Figure 5:
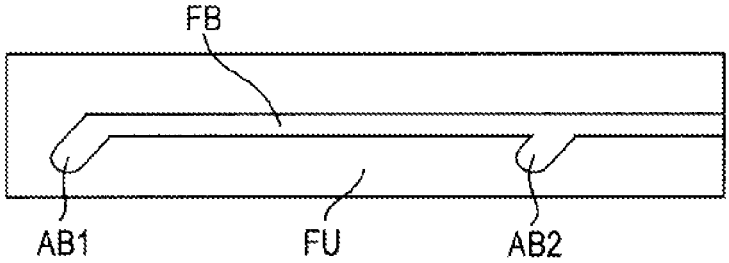

In FIG. 4 there are additional guide pins or guide rollers FS indicated by dashed lines on the outer long sides of the collection container SA. The guide pins or rollers FS provided in this manner on each outer side of the collection container SA depicted in FIG. 4 can each be accommodated by a guide track FB of a guide rail FU, of which one is shown in FIG. 5. Two such guide rails are attached to the relevant long sides of the collection container SA on the inner side of the receiving opening GO mentioned with reference to FIGS. 2 and 3. These guide pins or guide rollers FS and the associated guide rails with thereby tracks for the relevant guide pins or rollers FS can be provided as an alternative to the cams NO1, NO2 and cam receivers NA1, NA2 shown in FIGS. 2 and 3.

The said guide rails FU can each contain sunken areas AB1 and AB2 for lowering the collection container SA in its completely inserted state in accordance with FIG. 2 into the said receiving opening GO, into which the associated guide pins or rollers FS of the collection container SA are able to be received. It should be mentioned here that naturally corresponding tracks can be provided for the guide track FB shown in FIG. 5 with its lowering areas AB1 and AB2 in the long outer sides of the collection container SA shown in FIG. 4 and that the receiving opening GO mentioned with reference to FIGS. 2 and 3 can be provided with corresponding guide pins or rollers which enable the collection container SA with its guide track FB to be accommodated. In this case however the respective guide track FB with its lowering areas AB1 and AB2 is provided in the respective long outer side of the collection container SA in such a way that it is open at the end shown on the left in FIG. 4 and has lowering areas AB1 and AB2 pointing towards the opposite end. In this case guide tracks with their own lowering areas can be provided for the individual guide pins or rollers.

To return to the inventive device shown in FIG. 1, the outlet area of the downpipe FR will now be discussed with reference to FIGS. 6 and 7, from which the condensation water dispensed as a gush of water from the rinsing chamber SB of the collection container SA in each case emerges for cleaning the evaporator EV forming the component to be cleaned.

Figure 6:
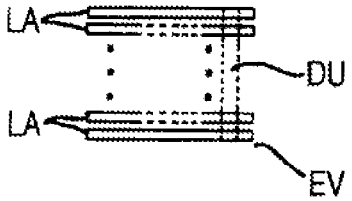

As can be seen from FIG. 6, in which an overhead view of the evaporator in the device shown in FIG. 1 is shown in a schematic diagram, the evaporator EV consists of a series of fins LA running in parallel to each other. These fins are formed by metal plates which are cooled in the said condenser device so that moisture from the moist process air supplied to them from the right side in FIG. 6 is condensed on the cold surfaces of the fins LA, as illustrated in FIG. 1, for output of condensation water to the condensation water pan shown in this figure. In FIG. 6 the static position of the rinsing nozzle DU in relation to the evaporator EV is shown.

Figure 7:
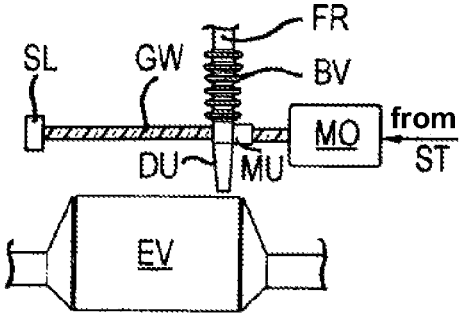

While the rinsing nozzle DU is arranged in a fixed location in relation to the evaporator EV for the evaporator shown in FIGS. 1 and 3, FIG. 7 shows a device in which the rinsing nozzle DU is able to be displaced, or more accurately deflected, in relation to the evaporator EV. In accordance with FIG. 7 a drive device is provided above the evaporator EV of the said condenser device, which consists of an electric motor able to be controlled by the control device ST, a threaded spindle GW able to be rotated by said motor and also a female connection MU coupled to this, which is connected to the rinsing nozzle DU. The threaded spindle GW, as indicated in FIG. 7, is supported at the end lying away from the motor MO by a support bearing SL.

The rinsing nozzle DU is connected in accordance with FIG. 7 with the downpipe by a movable connecting part BV, which for example can be formed by a bellows section or a corrugated hose. This displaceability of the rinsing nozzle DU in relation to the evaporator EV enables the rinsing nozzle to be deflected during the dispensing of a gush of water from a starting area located at an inlet area of the process air in the evaporator EV of the condenser device up to an end area lying at a distance therefrom in the direction of the outlet area of the process air from the evaporator EV. This means that the fins LA of the evaporator in accordance with FIG. 6 can be rinsed over a defined length, for example over their entire length, by means of the condensation water gushing out of the downpipe FR and the rinsing nozzle.

In addition it is pointed out that dispensing of a gush of condensation water explained here passing through the downpipe FR and the rinsing nozzle DU from a starting area located at the inlet area of the process air in the evaporator EV of the condenser device through to an end area lying at a distance therefrom towards the outlet area of the process air from the evaporator EV can also be undertaken by the downpipe FR being deflected accordingly together with the rinsing nozzle DU. In addition the deflection mentioned can also be illustrated in a way other than that shown in FIG. 7, i.e. generally by a mechanically or electromechanically-actuated deflection device.

The modification shown in FIG. 8 of the inventive device depicted in FIG. 1 will now be discussed. The device shown in FIG. 8 differs from that shown in FIG. 1 in accordance with the present invention essentially in that in addition to the condensation water dispensed as a gush of water from the rinsing chamber SB of the collection container SA, normal mains water at a pressure of for example 3 bar to 6 bar can also be dispensed for cleaning purposes. For this reason only the features by which the device shown in FIG. 8 differs from the device shown in FIG. 1 will be referred to below.

Figure 8:
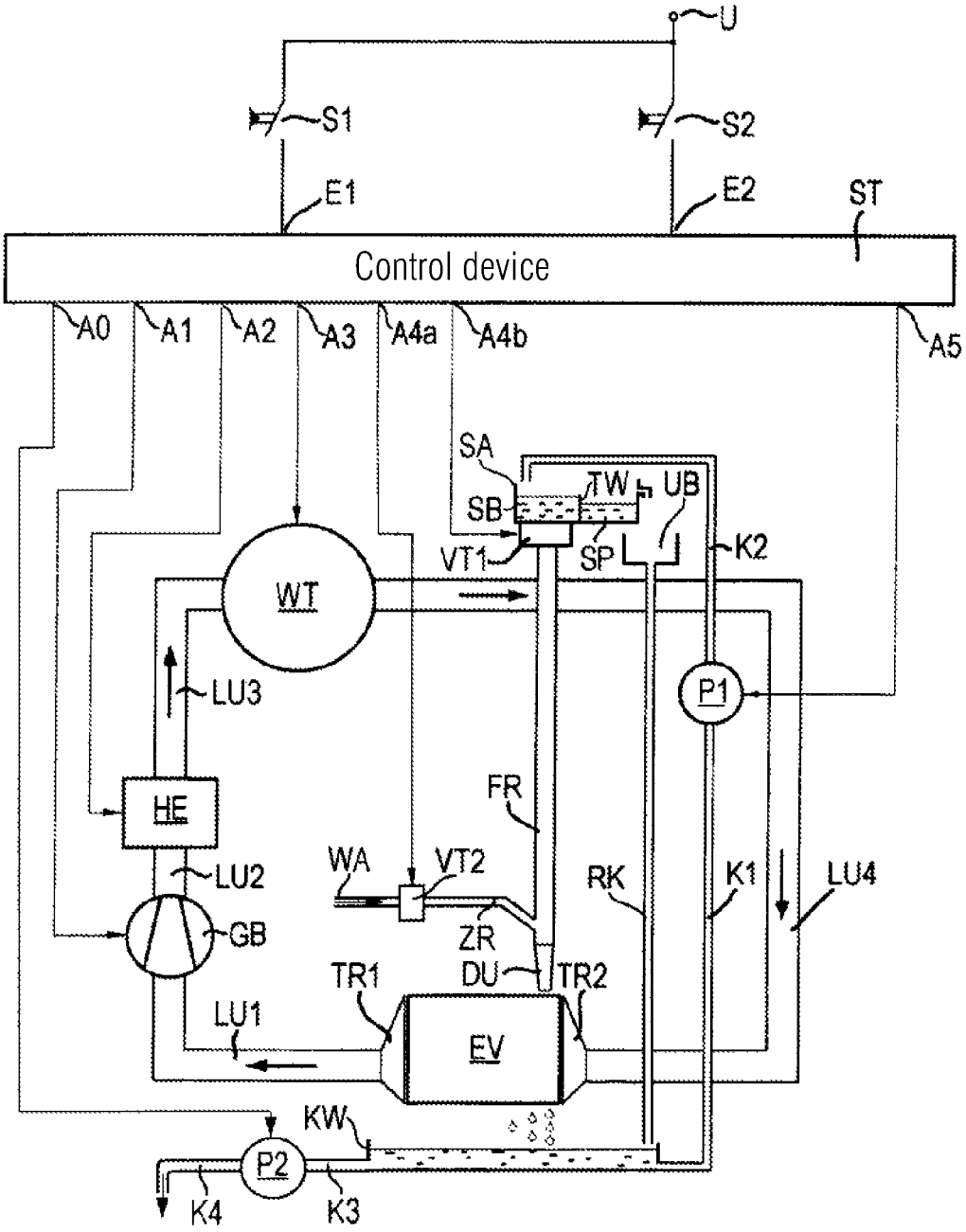

In accordance with FIG. 8 a water inlet pipe WA is provided to which the pressurized mains water is directed. According to FIG. 1 a closure part VT2 is connected to the output side of the relevant water inlet pipe WA, with said closure part typically involving a normal shut-off valve which is able to be controlled from an output terminal A4*a* of the control device ST. The output terminal A4*b* of the control device ST shown in FIG. 8 corresponds to the output terminal A4 of the control device ST shown in FIG. 1, with the control device ST shown in FIG. 8 otherwise being identical in its structure and its method of operation.

Provided on the output side of the closure of part VT2 is a water outlet pipe ZR which extends in the lower area of the downpipe FR into the latter, i.e. in accordance with FIG. 1 above the rinsing nozzle DU of the relevant downpipe FR. In this way the mains water can be dispensed to supplement the condensation water dispensed as a gush of water from the rinsing container SB for cleaning the evaporator EV. This enables the pressurized mains water to be dispensed in an appropriate manner onto the evaporator EV in order to clean it, as has been explained in relation to the condensation water with reference to FIGS. 6 and 7.

In order to avoid an overflow of the condensation water pan KW when the pressurized mains water is dispensed, the condensation water caught in said pan can be pumped away with the aid of the pump P1 already mentioned or with the aid of a further electric pump P2. In such cases it is clear that only such a proportion of the condensation water collected in each case in the condensation water pan KW1 is to be pumped away by means of the pump P1 which corresponds to the capacity of the rinsing chamber SB and/or of the storage chamber SP. The proportion of condensation water going beyond this which is output to the condensation water pan KW is to be pumped away by means of the pump P2 into an outflow arrangement.

This additional dispensing of mains water under pressure for cleaning the evaporator EV enables it to be cleaned outstandingly well. The relevant dispensing of mains water for cleaning the evaporator EV is especially of particular importance for a washer/dryer which in any event has a mains water inlet device and a mains water outlet device available to it.

In conclusion it should also be mentioned that the device in accordance with the present invention can also be implemented in a manner other than that which has been explained in this document. It is thus possible for example to arrange the collection container SA so that it is divided by means of the partition wall TW into and at least approximately round central rinsing chamber SB and into a storage chamber SB surrounding said rinsing chamber. In this case the funnel-shaped depression of the outlet opening AU in the floor area of the rinsing chamber mentioned in conjunction with FIG. 4 can be implemented especially easily. The actuation arrangement for sudden opening of the relevant outlet opening AU can also be constructed in a way other than has been explained above.

LIST OF REFERENCE SIGNS

AO, A1, A2, A3, A4, Output terminals
A4*a*, A4*b*, A5

AB1, AB2 Lowering areas
AU Outlet opening
BE Actuation device
BV Movable connection part
DE Cover
DI Sealing element of disk
DL Sealing areas or lips
DU Rinsing nozzle
E1, E2 Input terminals
EN Narrowing area
EL Inlet area
EV Evaporator
FB Guide track
FE Bistable spring
FR Downpipe
FS Guide pin
FU Guide rails
GB Fan
GK Device body
GO Receiving opening
GR Handle it
GW Threaded spindle
HE Heating device
K1, K2, K3, K4 Connection ducts
KW Condensation water tank
LA Fins
LU1, LU2, Process air ducts
LU3, LU4
MO Electric motor, motor
MU Female connection
NA1, NA2 Cam receivers
NO1, NO2 Cams
OP1, OP2 Openings
P1, P2 Electric pump
PU Buffer
RK Return duct
S1, S2 Switch
SA Collection container
SB Rinsing chamber
SP Storage chamber
SL Support bearing
ST Control device
TE Closure plate
TL Spring support
TR1, TR2 Funnel-type connections (transition sections)
TT1 Support part
TT2 Actuation pin
TW Partition wall
U Power connection
UB Overflow container
VT1, VT2 Closure parts
WA Water supply pipe
WT Washer/dryer or dryer drum
ZR Water drain pipe

The invention claimed is:

1. A device for cleaning an evaporator of a condenser with condensation water, the device comprising:

a condensation water pan configured to collect condensation water condensed from process air by the evaporator;

a collection container above the evaporator configured to receive the condensation water collected by the condensation water pan;

a control device; and a downpipe to direct the condensation water onto the evaporator from the collection container, wherein the collection container further comprises a rinsing chamber having an outlet fluidly joining the rinsing chamber to the downpipe and a closure plate positioned on the collection container to cover the outlet in a closed position of the closure plate, the closure plate being configured to be actuated by the control device to open the outlet and allow a flow of condensation water to flow from the rinsing chamber to the downpipe, wherein the collection container further comprises a storage chamber configured to receive condensation water overflowing from the rinsing chamber, wherein the collection container further comprises a partition wall extending between the rinsing chamber and the storage chamber from a bottom of the collection container, and wherein the closure plate further comprises a support pin extending from a bottom side of the closure plate into an opening in the bottom of the collection container to lift the closure plate into an open position, the opening being separate from the outlet such that the support pin is separated from a flow path of the flow of condensation water flowing from the outlet to the downpipe.

2. The device of claim 1, further comprising a pressurized water supply configured to dispense pressurized water onto the evaporator.

3. The device of claim 1, wherein the collection container is removable from a receiving device to empty the condensation water from the storage chamber of the collection container.

4. The device of claim 1, wherein a cross-section of the downpipe along at least a portion of a length of the downpipe is narrower than a cross section of the outlet of the rinsing chamber.

5. The device of claim 1, wherein a rinsing nozzle of the downpipe is located at a fixed position relative to an evaporator inlet.

6. The device of claim 1, wherein a rinsing nozzle of the downpipe is movable between a first position proximal to an evaporator inlet and a second position proximal to an evaporator outlet.

7. The device of claim 1, further comprising a pump to pump the condensation water from the condensation water pan to the collection container.

8. The device of claim 1, further comprising a mains water line configured to supply pressurized mains water to the downpipe such that the downpipe dispenses the pressurized mains water onto the evaporator from above.

9. The device of claim 8, wherein the control device is configured to control a supply of pressurized mains water to the downpipe.

10. The device of claim 3, wherein the closure plate and the collection container are connected by the support pin such that the closure plate is removable with the collection container.

11. The device of claim 1, wherein the collection container further comprises peripheral walls, the partition wall being lower in height than the peripheral walls.

12. The device of claim 11, wherein the partition wall has a height such that condensation water overflows into the storage chamber when the rinsing chamber contains 2.5 liters of water.

13. The device of claim 1, further comprising a drain or a pump to remove condensation water from the storage chamber.

14. The device of claim 1, further comprising an overflow container configured to receive condensation water overflowing from the storage chamber.

15. The device of claim 14, further comprising a return channel to direct condensation water from the overflow container to the condensation water pan.

16. The device of claim 3, wherein the collection container further comprises a grip for removal of the collection container from the receiving device.

17. The device of claim 1, wherein the rinsing chamber is shaped and dimensioned to contain 2.5 liters of condensation water.

18. The device of claim 1, wherein the collection container is configured to dispense the condensation water contained in the rinsing chamber from the downpipe and onto the evaporator within a duration of 2 seconds or less.

19. The device of claim 1, wherein the collection container is configured to dispense the condensation water contained in the rinsing chamber from the downpipe and onto the evaporator at a flow of at least 75 liters per minute.

20. The device of claim 1, wherein the rinsing chamber and the storage chamber are positioned laterally adjacent to one another.

21. The device of claim 1, wherein the partition wall extends vertically from the bottom of the collection container.

22. The device of claim 1, further comprising an actuation pin, wherein the actuation pin is positioned such that an end of the actuation pin contacts an end of the support pin opposite the closure plate to push the closure plate into the open position.

23. The device of claim 22, further comprising a bistable spring configured to operate the actuation pin to displace the support pin and the closure plate and open the outlet of the rinsing chamber.

24. The device of claim 23, further comprising a thermal or magnetic relay coupled to the bistable spring and configured to actuate the bistable spring.

25. The device of claim 23, further comprising an actuation device, wherein the control device is configured to control the actuation device to operate the bistable spring for opening and closing the closure plate.

26. The device of claim 25, wherein the actuation pin, the bistable spring, and the actuation device are separated from the flow of condensation water from the rinsing chamber to the downpipe.

27. The device of claim 1, wherein the support pin is dimensioned such that an end of the support pin opposite the closure plate does not extend out from the opening in the closed position.

28. The device of claim 1, further comprising a sealing disk positioned to form a seal between the outlet and the downpipe.

29. A household appliance for treatment of laundry, comprising:

an evaporator configured to condense condensation water from process air;

a drum to contain the laundry during treatment;

at least one process air duct connecting the drum and the evaporator; and the device of claim 1.

30. A method for cleaning an evaporator of a condenser with condensation water, the method comprising:

acquiring condensation water from air in a process air circuit from drying moist laundry;

collecting the condensation water in a condensation water pan;

feeding the condensation water to a rinsing chamber of a collection container, the collection container located above the evaporator; and opening a closure plate with a control device to dispense a flow of condensation water from the rinsing chamber and through an outlet of the rinsing chamber to a downpipe and onto the evaporator, the closure plate being positioned on the collection container to cover the outlet in a closed position of the closure plate, wherein the collection container further comprises a storage chamber configured to receive condensation water overflowing from the rinsing chamber, and wherein the collection container further comprises a partition wall extending between the rinsing chamber and the storage chamber from a bottom of the collection container, and wherein the closure plate further comprises a support pin extending from a bottom side of the closure plate into an opening in the bottom of the collection container to lift the closure plate into an open position, the opening being separate from the outlet such that the support pin is separated from a flow path of the flow of condensation water flowing from the outlet to the downpipe.

31. The method of claim 30, further comprising dispensing pressurized mains water onto the evaporator from above.

32. The method of claim 30, further comprising:

removing the collection container from a receiving device; and draining the condensation water by emptying the collection container.

33. The method of claim 30, further comprising draining the condensation water by draining or pumping the condensation water into a waste water catching device.

34. The method of claim 30, wherein dispensing of the condensation water is at a constant flow rate during dispensing.

35. The method of claim 30, further comprising dispensing the condensation water from a rinsing nozzle of the downpipe located at a fixed position relative to an inlet area of the process air into the evaporator.

36. The method of claim 30, further comprising dispensing the condensation water from a rinsing nozzle of the downpipe by moving the rinsing nozzle between a first position proximal to an evaporator inlet and a second position proximal to an evaporator outlet.

37. The method of claim 30, further comprising pumping the condensation water from the condensation water pan to the collection container.

38. The method of claim 30, wherein the rinsing chamber is shaped and dimensioned to contain 2.5 liters of condensation water.

39. The method of claim 30, further comprising supplying pressurized mains water to the downpipe from a mains water line such that the downpipe dispenses the pressurized mains water onto the evaporator from above.

40. The method of claim 39, further comprising controlling the supplying of the pressurized mains water to the downpipe with the control device.

41. The method of claim 30, further comprising receiving condensation water overflowing from the storage chamber in an overflow container.

42. The method of claim 41, further comprising directing condensation water from the overflow container to the condensation water pan with a return channel.

43. The method of claim 30, wherein the collection container further comprises peripheral walls, the partition wall being lower in height than the peripheral walls.

44. The method of claim 43, wherein the partition wall has a height such that condensation water overflows into the storage chamber when the rinsing chamber contains 2.5 liters of water.

45. The method of claim 32, wherein the closure plate is attached to the collection container such that the closure plate is removed with the collection container.

46. The method of claim 32, wherein the collection container further comprises a grip for removal of the collection container from the receiving device.

47. The method of claim 30, further comprising dispensing the condensation water from the rinsing chamber, through the downpipe, and onto the evaporator at a flow rate of at least 75 liters per minute.

48. The method of claim 30, further comprising dispensing the condensation water from the rinsing chamber, through the downpipe, and onto the evaporator within a duration of 2 seconds or less.

49. The method of claim 30, wherein the rinsing chamber and the storage chamber are positioned laterally adjacent to one another.

50. The method of claim 30, wherein the partition wall extends vertically from the bottom of the collection container.

51. The method of claim 30, wherein opening the closure plate further comprises pushing the closure plate into the open position by contacting an end of an actuation pin with an end of the support pin opposite the closure plate.

52. The method of claim 51, further comprising actuating the actuation pin with a bistable spring to open the closure plate.

53. The method of claim 52, wherein actuating the bistable spring comprises actuating the bistable spring with one of a thermal relay and an electromagnetic relay.

54. The method of claim 52, further comprising opening and closing the closure plate by controlling an actuation device with the control device to operate the bistable spring and actuate the actuation pin.

55. The method of claim 54, wherein the actuation pin, the bistable spring, and the actuation device are separated from the flow of condensation water from the rinsing chamber to the downpipe.

56. The method of claim 30, wherein the support pin is dimensioned such that an end of the support pin opposite the closure plate does not extend out from the opening in the closed position.

57. The method of claim 30, further comprising a sealing disk positioned to form a seal between the outlet and the downpipe.

* * * * *